US005209090A

United States Patent [19]

Stillwagon

[11] Patent Number: 5,209,090

[45] **Date of Patent: * May 11, 1993**

[54] OBJECT RETENTION APPARATUS

[75] Inventor: Woodrow C. Stillwagon, Fulton County, Ga.

[73] Assignee: Stillwagon Applied Technology, Inc., Columbus, Ohio

[ * ] Notice: The portion of the term of this patent subsequent to Oct. 22, 2008 has been disclaimed.

[21] Appl. No.: 717,923

[22] Filed: Jun. 20, 1991

Related U.S. Application Data

[63] Continuation-in-part of Ser. No. 562,638, Aug. 6, 1990, Pat. No. 5,058,405.

[51] Int. Cl.[5] ..... A47G 29/10

[52] U.S. Cl. ..... 70/456 R; 24/3 K; 70/63; D3/61

[58] Field of Search ..... 70/456 R–459, 70/63; 24/3 K; D3/61, 62, 64; 206/37.1, 38, 38.1, 535–537

[56] References Cited

U.S. PATENT DOCUMENTS

| | | | |
|---|---|---|---|
| D. 153,677 | 6/1947 | Georganta | D17/14 |
| D. 235,385 | 6/1975 | Smyth | D87/8 |
| D. 271,443 | 11/1983 | MacDonald | D3/61 |
| D. 285,987 | 10/1986 | MacDonald | D3/61 |
| D. 299,480 | 1/1989 | Harai | D3/61 |
| D. 306,799 | 3/1990 | Colàn | D3/61 |
| D. 308,601 | 6/1990 | MacDonald | D3/61 |
| D, 310,136 | 8/1990 | MacDonald | D3/61 |
| D. 310,306 | 9/1990 | MacDonald | D3/61 |
| D. 310,447 | 9/1990 | MacDonald | D3/61 |
| D. 310,753 | 9/1990 | Stillwagon et al. | D3/61 |
| D. 317,080 | 5/1991 | Stillwagon et al. | D3/61 |
| D. 318,952 | 8/1991 | Stillwagon et al. | D3/61 |
| 760,410 | 5/1904 | Arnold . | |
| 1,835,793 | 7/1929 | Lorie | 70/456 |
| 2,129,915 | 2/1937 | DuPont | 206/38 |
| 2,232,333 | 2/1941 | McGehee | 70/456 R |

(List continued on next page.)

FOREIGN PATENT DOCUMENTS

| | | | |
|---|---|---|---|
| 0088699 | 9/1983 | European Pat. Off. | 70/456 R |
| 0117204 | 8/1984 | European Pat. Off. | 70/456 R |
| 625914 | 9/1961 | Italy | 70/456 R |

OTHER PUBLICATIONS

Photograph of top view of Disconnected Ball/Groove Key Chain.

Photograph of end view of One Member of Ball/-Groove Key Chain.

Photograph of top view of Disconnected Compression Ring Key Chain.

Photograph of end view of One Member of Compression Ring Key Chain.

*Primary Examiner*—Peter M. Cuomo
*Assistant Examiner*—Suzanne L. Dino
*Attorney, Agent, or Firm*—Louis T. Isaf

[57] ABSTRACT

An object retention apparatus which includes, in its most preferred embodiment, an outer body member and an inner body member, which inner body member is insertable into the outer body member and includes an interior storage compartment closed by a cap to seal in solids, such as heart medication tablets or diabetes medication and which is preferably designed to additionally seal a container or vial which fits within the compartment for storing liquids, such as perfume, cologne, breath freshener, etc. The object retention apparatus also features two attachment rings attached to the body members and a quick release mechanism to allow separation of the two body members and, thus, the rings. The quick release mechanism includes a push button, a retaining loop, a biasing device, and a retaining ring device for holding the release mechanism in place. In an alternate embodiment, the inner body consists of a whistle. The quick release mechanism also has application in other devices unrelated to object retention.

40 Claims, 8 Drawing Sheets

U.S. PATENT DOCUMENTS

| | | | |
|---|---|---|---|
| 2,969,823 | 5/1959 | Sherwood | 150/40 |
| 3,186,052 | 6/1965 | Bobrow | 24/201 |
| 3,299,679 | 1/1967 | Anderson | 70/459 |
| 3,587,262 | 6/1971 | Kaye | 70/456 |
| 3,600,917 | 8/1971 | Krock | 70/459 |
| 3,618,346 | 7/1970 | Humphrey | 70/408 |
| 3,777,523 | 12/1973 | Holland | 70/456 |
| 3,906,763 | 9/1975 | Bochory | 70/456 |
| 4,079,607 | 3/1978 | Sproyt | 70/456 |
| 4,248,071 | 2/1981 | Kussoy | 70/456 |
| 4,265,459 | 8/1988 | Edwards | 70/456 R X |
| 4,422,316 | 12/1983 | Thomas et al. | 70/456 |
| 4,524,594 | 6/1985 | Bascou | 70/456 |
| 4,733,807 | 3/1988 | Porter et al. | 206/38 |
| 4,776,191 | 10/1988 | MacDonald | 70/459 |
| 4,821,543 | 4/1989 | Scungio | 70/456 |
| 4,833,902 | 5/1989 | Mori | 70/456 R |
| 4,951,489 | 8/1990 | Proch | 70/456 |
| 4,974,982 | 12/1990 | Nielson | 70/456 R X |
| 5,018,621 | 5/1991 | O'Connell | 206/535 |
| 5,058,405 | 10/1991 | Stillwagon | 70/456 R |

OBJECT RETENTION APPARATUS

CROSS-REFERENCES TO RELATED APPLICATIONS

This application is a continuation-in-part of application Ser. No. 07/562,638, filed Aug. 6, 1990, allowed Apr. 5, 1991, and now U.S. Pat. No. 5,058,405.

BACKGROUND OF THE INVENTION

The present invention relates generally to containers, and specifically to containers which can be carried in the pocket or purse and separated into two or more parts, with object attachment capabilities.

Numerous container designs are in use today, from simple bags/cases to deluxe key chains finished to match accessory items, such as wallets and purses. Some are designed to include two ring portions which can be separated temporarily. With such a two ring container, keys attached to these rings can be divided logically, with one group of keys, such as keys for the home, on one ring and another group of keys, such as car or office, on the second ring.

When car keys are attached to a second key ring, the ability to detach the car keys provides an extra measure of safety when leaving a car with a parking attendant or at a service garage. Doing so greatly reduces the chances of home or office keys falling into the wrong hands, and allows other items to be carried separately. Many people often consider separating car keys from other keys when leaving their car with a stranger; a separatable device makes it easier to do so and increases the likelihood of actually following through with the idea.

Containers are usually carried in a pocket or purse, where they compete with gum, candy, pill boxes, cosmetics, coin change, combs and other personal items for a limited amount of space. Many people prefer to "travel light" and often look for ways to reduce the number of items that must be carried. One way to achieve this goal is to combine two or more items in a multi-purpose single container. Also, many currently available release mechanisms are difficult to operate, unreliable, or have relatively short life spans.

SUMMARY OF THE INVENTION

Briefly described, the present invention, in its most preferred embodiment, comprises an object retention device which includes an outer body member and an inner body member which is insertable into the outer body member. An attachment ring is attached to one end of each body member. The inner body member includes an inner cavity and a cap for enclosing the cavity. A vial for holding liquids, such as perfume, cologne, or breath freshener, is enclosed within the inner cavity and sealed by the same cap which encloses the inner cavity. In one alternate embodiment, the cap includes a wick for use with the liquid contained within the vial. In another alternate embodiment, the vial is omitted, and the inner cavity may be used to store solids, such as heart or diabetes medications.

A push button release assembly controls the relationship between the outer body member and the inner body member. The inner body member becomes secured within the outer body member upon insertion into the outer body member. When the push button is depressed, the inner body member may be easily removed from the outer body member. In the preferred embodiment, the push button release assembly includes a release button, a retaining loop which extends down into the outer body member, a leaf spring, and a retaining ring for holding the release assembly in place. In alternate embodiments, the push button release assembly includes variously shaped release buttons and retaining loops and, instead of a leaf spring, a coil spring, an elastic ring, or spring plates.

Although the preferred embodiment disclosed in this specification functions as a container with two attachment rings, other embodiments are contemplated which have a different number of attachment mechanisms and other compartmental arrangements. For example, another embodiment of the invention comprises a body member, with a storage compartment accessible from one side and a key ring mounted on another side. Still other embodiments considered to be within the scope of the invention include an object retention device without any key rings or attachment mechanisms. Other embodiments include using a ring to attach items, such as a nail clip, mace, whistle or flashlight. In another alternate embodiment, the inner body member is a whistle, thus having no storage capability. Furthermore, the disclosed push button release assemblies are understood to be adaptable to other devices unrelated to object retention.

It is therefore an object of the present invention to provide an object retention device with an inner storage compartment, the device being separated into at least two parts and including a push button, quick release mechanism to allow easy separation of the parts.

Another object of the present invention is to provide a storage compartment cap which includes a wick to absorb and store liquids held in the compartment.

Yet another object of the present invention is to provide an object retention device which includes at least one object attachment device.

Still another object of the present invention is to provide an object retention device which includes multiple object attachment devices, at least one of which can be detached from the object retention device.

Still another object of the present invention is to provide a reliable, quick release, push button release mechanism.

Other objects, features and advantages of the present invention will become apparent upon reading and understanding this specification, taken in conjunction with the accompanying drawings.

BRIEF DESCRIPTION OF THE DRAWINGS

FIG. 16b is an isolated cross-sectional front view, taken along line 16b of FIG. 16a.

DETAILED DESCRIPTION OF THE PREFERRED EMBODIMENT

Figure 1:
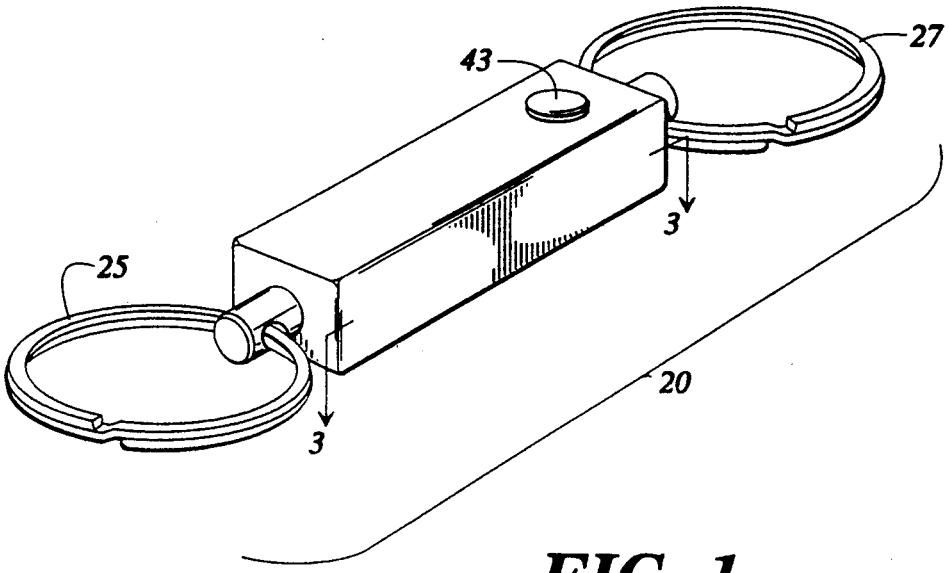
FIG. 1 is a pictorial view of the preferred embodiment of the present invention, with the two body members joined together.
Figure 2:
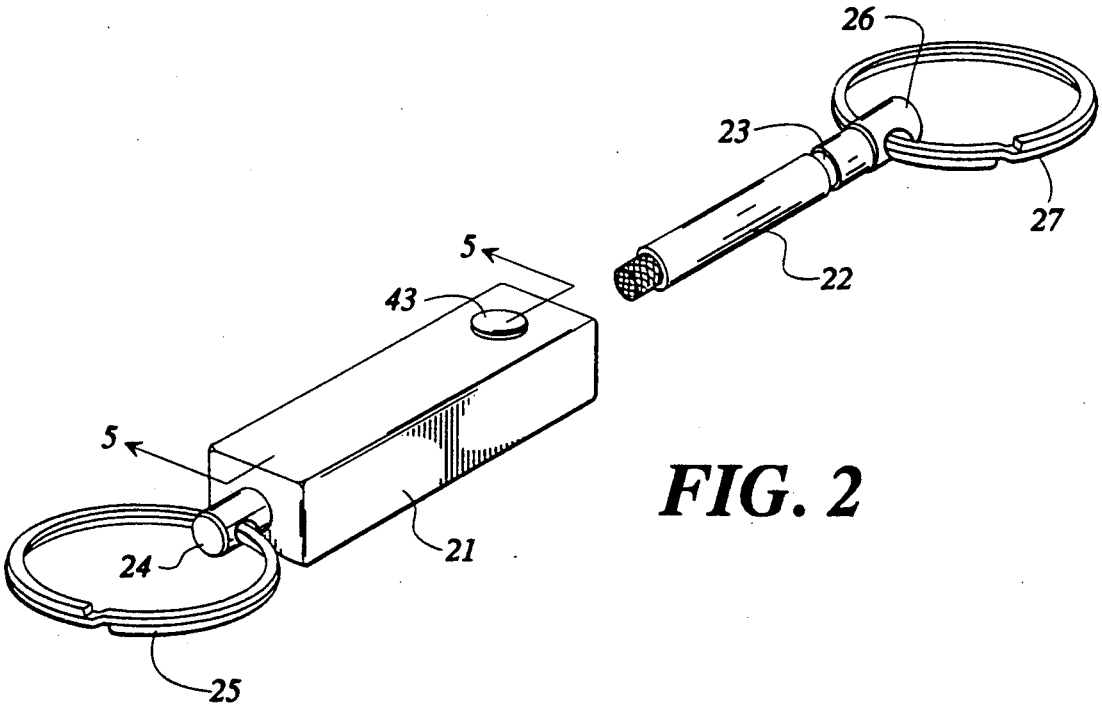
FIG. 2 is a pictorial view of the embodiment of FIG. 1, showing the two body members separated.

Referring now in greater detail to the drawings, in which like numerals represent like components throughout the several views, the preferred embodiment of the object retention device 20 of the present invention is shown in FIGS. 1 and 2 as including an outer body 21 and an inner body 22 which can be coupled, as in FIG. 1, or separated into two parts, as shown in FIG. 2. Outer body ring 25 is attached to outer body 21 through attachment swivel 24, and inner body ring 27 is attached directly to inner body outer end 26.

Figure 3:
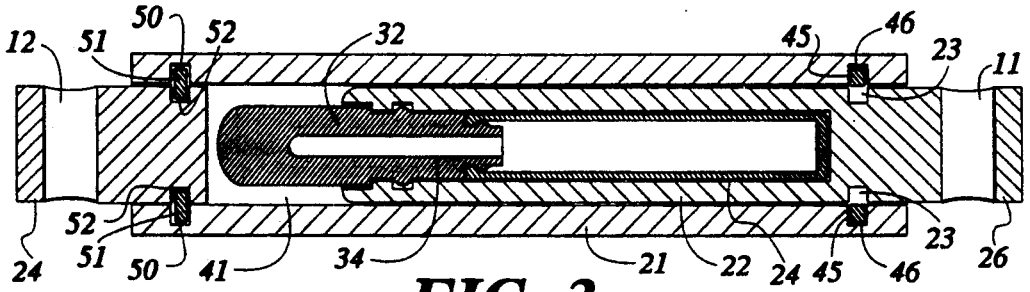
FIG. 3 a cross-sectional top view of the preferred embodiment of FIG. 1, taken along line 3—3 of FIG. 1.

FIG. 3 is a cross-sectional top view of the preferred embodiment of FIG. 1, taken along line 3—3 of FIG. 1, and shown without rings 25 and 27 of FIGS. 1 and 2. In addition, an alternate embodiment of inner body outer end 26 is shown having a smaller diameter than that of the preferred embodiment shown in FIGS. 1 and 2. Inner body 22 is seen located within outer body cavity 41 of outer body 21. Retaining loop 45 is seen located within outer body loop channel 46, with which inner body loop channel 23 is aligned. As is discussed in greater detail below, the lower section of retaining loop 45 (not shown in FIG. 3) interacts with both outer body loop channel 46 and inner body loop channel 23 to couple inner body 22 to outer body 21.

Attachment swivel 24 is linked to outer body 21 in the preferred embodiment by washer 51 located partially within both swivel washer channel 52 and outer body washer channel 50. During assembly, washer 51, manufactured in a 'C' shape, is compressed into swivel washer channel 52 as attachment swivel 24 is inserted into outer body 21. As washer 51 aligns with outer body washer channel 50, washer 51 expands into outer body washer channel 50 to securely connect attachment swivel 24 to outer body 21. Washer 51 is preferably made of nylon. Outer body ring hole 12 and inner body ring hole 11 are also seen in FIG. 3 and are considered to teach one of many acceptable methods of attaching objects to bodies 21 and 22.

Figure 4A:
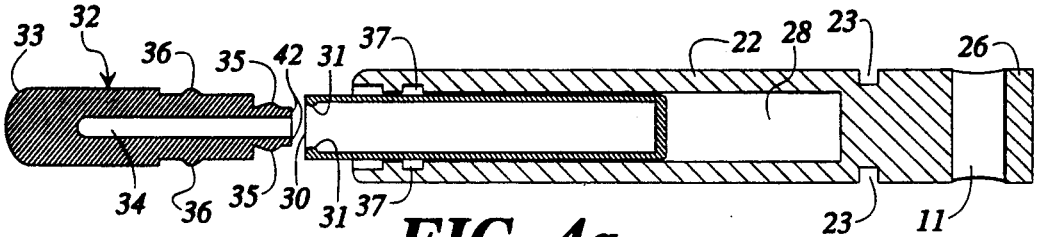
FIG. 4*a* is a cross-sectional top view, similar to FIG. 3, of the inner body with disconnected elements.

FIG. 4a shows a cross-sectional top view, similar to FIG. 3, of inner body 22 with disconnected elements. Cap 32 is seen removed from vial 29 and inner body 22, thus providing access to vial 29 and storage area 28. Vial 29 forms an elongated container, with vial opening 30 at one end. A raised bead 31 (or "domed" section) is defined around the interior of vial opening 30. In the preferred embodiment, cap 32 is designed for at least two purposes: insertion into vial opening 30 to seal the contents of vial 29, and insertion into and sealing of storage area 28. To effect a seal between cap 32 and vial 29, vial retention ring 35 engages with raised bead 31 of vial 29, and to effect a seal between cap 32 and inner body 22, body retention ring 36 engages with cap retention channel 37 of inner body 22.

Cap 32 can be easily removed through gripping textured grip end 33. One feature of cap 32 is to enable separation between cap 32 and inner body 22 while maintaining a connection between cap 32 and vial 29. In the preferred embodiment, compression channel 34 begins at appendage 42 of cap 32 and extends at least partially through the center of cap 32. The design of compression channel 34 and the flexibility of the preferred construction material allow cap 32 to compress in a limited area near body retention ring 36 without dislodging vial 29 from cap 32. Cap 32 and vial 29 of the preferred embodiment are made of plastic. Because one possible use of vial 29 is to carry various substances, such as perfume, the plastic selected should not be affected by nor have an effect on the substance vial 29 is intended to hold.

Figure 4B:
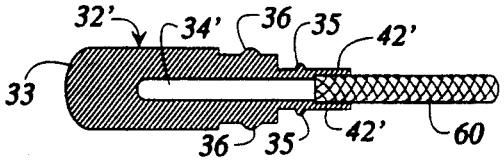
FIG. 4*b* is an alternate embodiment of a cap with a wick.

FIG. 4b shows cap 32', an alternate embodiment which includes wick 60 inserted into compression channel 34'. Appendage 42' of cap 32' is longer than appendage 42 seen in FIG. 4a so that wick 60 will not interfere with the previously discussed functions of compression channel 34. The extension of appendage 42' includes an extension of compression channel 34' with a greater diameter for receiving wick 60. The diameter transition provides a shoulder for limiting the depth of insertion of wick 60. Wick 60, constructed of cellulose in the preferred embodiment, is provided primarily as a tool for accessing liquids stored inside vial 29, for example, without limitation, cologne or perfume. Furthermore, when the supply of liquid in vial 29 and on wick 60 has been exhausted, wick 60 can be dipped into a reservoir of the liquid to replenish the supply. In still other embodiments, vial 29 is not used to store fluid, but to simply slow down evaporation of liquid on wick 60.

Figure 5A:
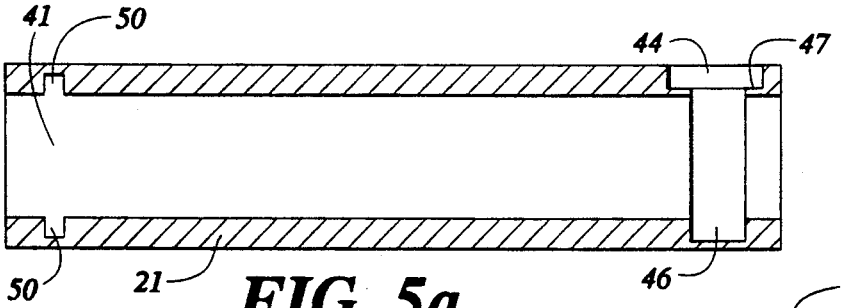
FIG. 5*a* is a cross-sectional right side view of the preferred embodiment of the outer body, taken along line 5—5 of FIG. 2.
Figure 5B:
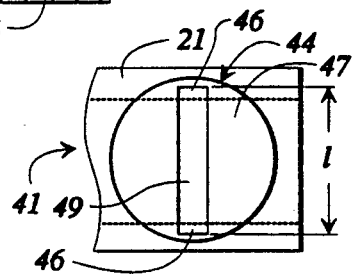
FIG. 5*b* is a cutaway top view of the rear end of the preferred embodiment of the outer body.

FIG. 5*a* shows a cross-sectional right side view of the preferred embodiment of outer body 21, taken along line 5—5 of FIG. 2. Outer body cavity 41 is seen extending through outer body 21, and outer body washer channel 50 appears similar to its representation in FIG. 3. Release aperture 44 is shown above release shoulder 47, and outer body loop channel 46 is seen extending downward into outer body cavity 41. FIG. 5*b* is a cutaway top view of the rear end of the preferred embodiment of outer body 21 showing the circular shape of release aperture 44. Loop slot 49 is seen extending from each end of outer body loop channel 46 with a length indicated by distance "l". Loop slot 49 also provides access to outer body cavity 41, represented by dotted lines extending throughout outer body 21.

Figure 6:
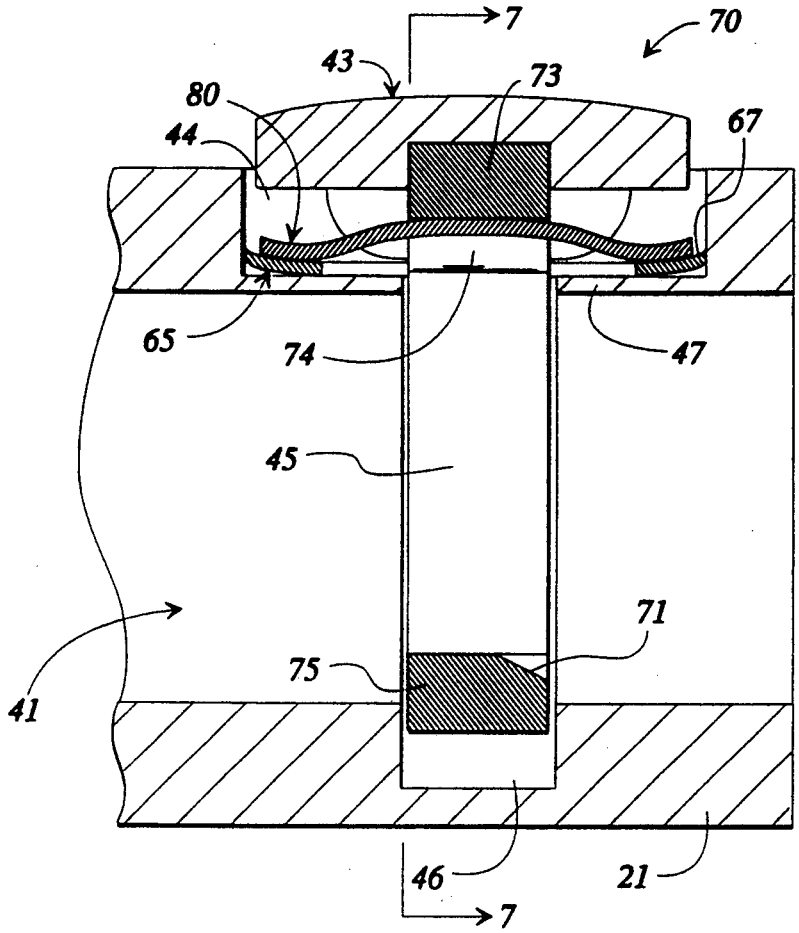
FIG. 6 is a cutaway cross-sectional right side view, similar to FIG. 5a, showing the rear end of the outer body along with the release assembly.
Figure 7:
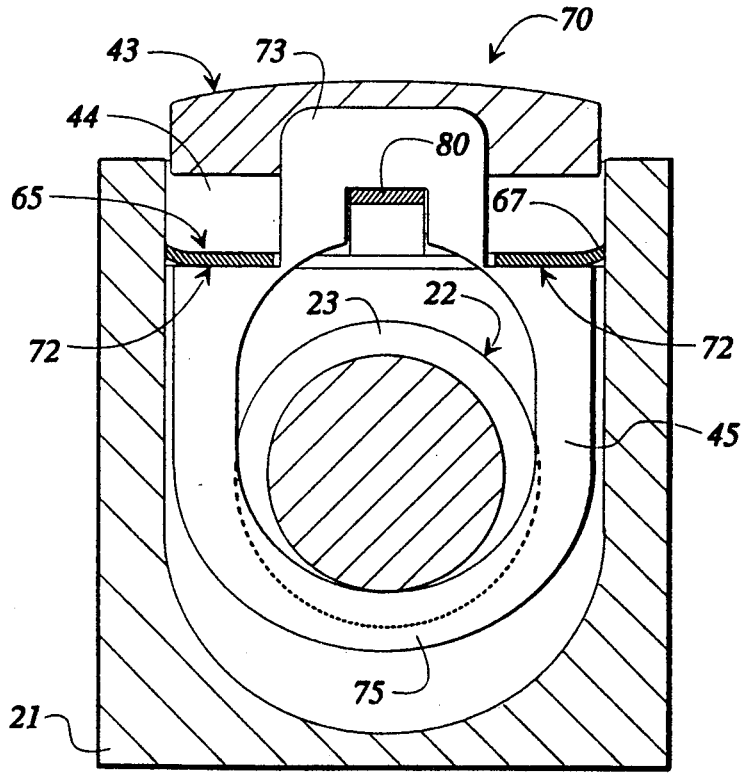
FIG. 7 is a cross-sectional front view of the outer body and the release assembly, taken along line 7—7 of FIG. 6.
Figure 8A:
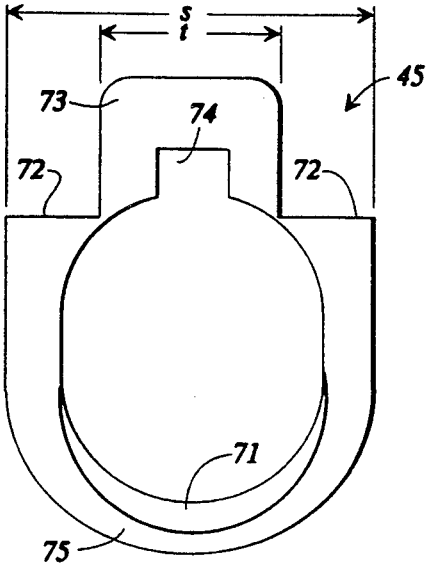
FIGS. 8a and 8b are isolated rear and cross-sectional left side views, respectively, of the retaining loop of FIG. 6.
Figure 8B:
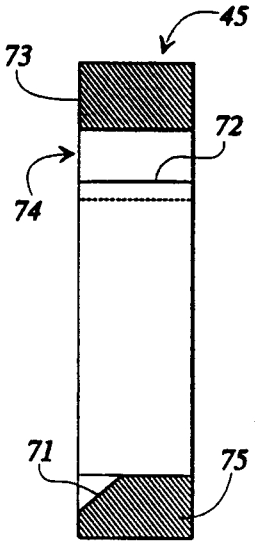

The preferred embodiment of the present invention further includes a release assembly 70 which is seen in more detail in FIGS. 6 and 7. FIG. 6 is a cutaway cross-sectional right side view, similar to FIG. 5*a*, showing the rear end of outer body 21 along with release assembly 70. FIG. 7 is a cross-sectional front view of outer body 21 and release assembly 70, taken along line 7—7 of FIG. 6. FIG. 7 also shows a sectional view of inner body 22 cut at inner body loop channel 23. Referring to FIG. 6, retaining loop 45 is seen extending down into outer body cavity 41. FIGS. 8*a* and 8*b* are isolated rear and cross-sectional left side views, respectively, of retaining loop 45. According to the preferred embodiment, loop taper 71 is seen included in loop bottom 75, and loop spring recess 74 is seen included in loop top 73, which extends between loop shoulders 72 with a length indicated by distance "t". Furthermore, in the preferred embodiment, the length of retaining loop 45 between the ends of loop shoulders 72, indicated by distance "s", is slightly less than the length of release slot 49, shown in FIG. 5*b* as length "l".

Figure 9A:
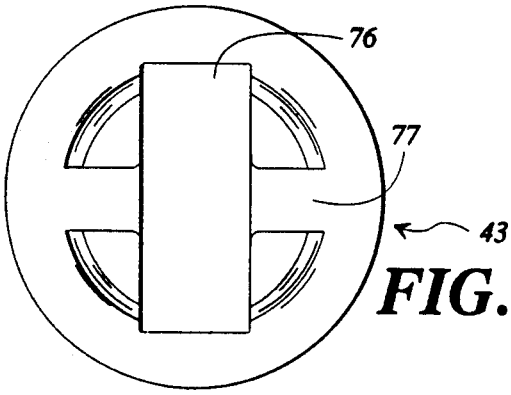
FIGS. 9a, 9b, and 9c are isolated bottom, cross-sectional right side, and cross-sectional front views, respectively, of the release button of FIG. 6.
Figure 9B:
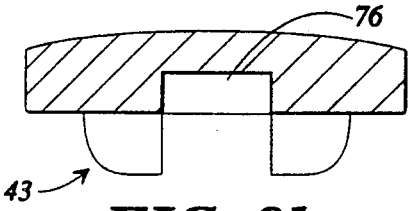
Figure 9C:
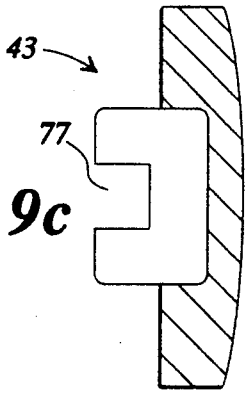
Figure 10A:
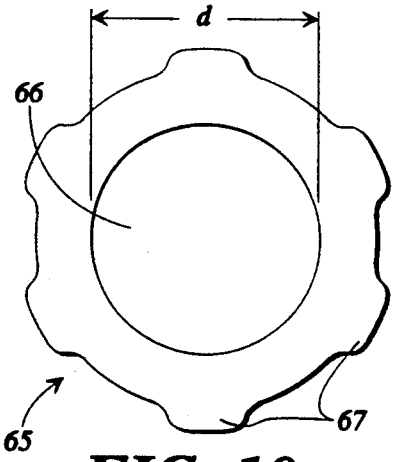
FIGS. 10a and 10b are isolated top and cross-sectional side views, respectively, of the retaining ring of FIG. 6.
Figure 10B:
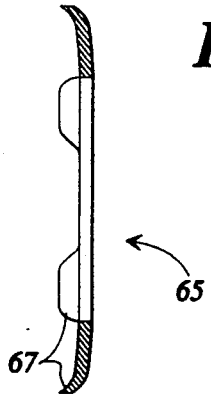
Figure 11A:
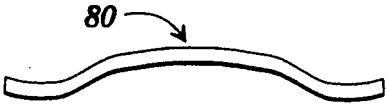
FIGS. 11a and 11b are isolated side and top views, respectively, of the leaf spring of FIG. 6.
Figure 11B:
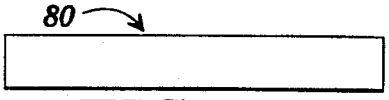

Referring back to FIGS. 6 and 7, release button 43 is seen connected to loop top 73. FIGS. 9*a*, 9*b*, and 9*c* show bottom, cross-sectional right side, and cross-sectional front views, respectively, of release button 43. Cap loop recess 76 is formed to securely receive loop top 73 as shown in FIGS. 6 and 7, and cap spring recess 77 is formed to receive leaf spring 80 as shown in FIGS. 6 and 7. Referring again to FIGS. 6 and 7, retaining ring 65 is seen resting on release shoulders 47 of outer body 21. FIGS. 10*a* and 10*b* show top and cross-sectional side views, respectively, of retaining ring 65. In the preferred embodiment, multiple ring wings 67 are seen extending radially out from the center of ring passage 66 and curving away from the plane of retaining ring 65. In other alternate embodiments, ring wings 67 are omitted, yet the overall diameter is maintained so that the functions of the two alternate retaining rings 65 are similar. In the preferred embodiment, the diameter of ring passage 66, indicated as distance "d", is slightly greater than the length of loop top 73 between loop shoulders 72, indicated as distance "t" in FIG. 8*a*. Also, leaf spring 80 is seen extending through loop spring recess 74 between loop top 73 and retaining ring 65. FIGS. 11*a* and 11*b* are side and top views, respectively, of leaf spring 80.

To assemble release assembly 70, retaining ring 65 is placed over loop top 73 to rest on loop shoulders 72 so that ring wings 67 are curved away from loop shoulders 72. Leaf spring 80 is then inserted through loop spring recess 74 so that the center of leaf spring 80 is in contact with loop top 73, and the ends of leaf spring 80 curve down to and press against retaining ring 65. This assembly is then inserted into release aperture 44 of outer body 21 so that the majority of retaining loop 45 passes through release slot 49 (shown in FIG. 5*b*) into outer body cavity 41. As retaining ring 65 enters release aperture 44, ring wings 67 come into contact with and wedge against the sides of recess release aperture 44. Because the length ("s") of release loop 45 is greater than the diameter ("d") of ring passage 66, loop shoulders 72 interact with retaining ring 65 to hold retaining loop 45 at least partially within outer body 21. Release button 43 is then attached to loop top 73. In the preferred embodiment, release button 43 snaps securely over loop top 73 so that friction holds release button 43 in place. Other attachment methods are contemplated, such as gluing or ultrasonically welding release button 43 to loop top 73. In the preferred embodiment, outer body 21, inner body 22 and release button 43 are made from brass or molded plastic. Retaining loop 45 is made from stamped brass. While these materials are preferred, other materials may be substituted, as appropriate, without departing from the spirit or scope of the invention.

During normal use, with reference to FIGS. 1-7, inner body 22 is ordinarily coupled within outer body 21. To access vial 29, bodies 21 and 22 must first be separated. This can be accomplished by depressing release button 43 and pulling inner body ring 27 away from outer body 21. During the coupled stage, inner body loop channel 23 of inner body 22 is aligned with outer body loop channel 46, and loop bottom 75 is partially positioned within inner body loop channel 23, as is shown in FIG. 7. The front, non-tapered, side of loop bottom 75 contacts the front side of inner body loop channel 23 to prevent inner body 23 from becoming separated from outer body 21. Leaf spring 80 maintains this position of retaining loop 45 by biasing retaining loop 45 upward. As release button 43 is depressed, compressing leaf spring 80, retaining loop 45 is moved downward so that loop bottom 75 clears inner body loop channel 23. Retaining loop 45 then no longer restrains inner body 22 and allows it to be easily removed from outer body 21.

When bodies 21 and 22 are separated, textured grip end 33 of cap 32 is revealed. To remove cap 32 from inner body 22, textured grip end 33 is grasped and pulled away from inner body 22. As a result, vial 29 also exits from storage area 28. Compression channel 34 is designed to allow cap 32 to be compressed in the immediate area of body retention ring 36 without releasing the seal between appendage 42 of cap 32 and vial opening 30, as is discussed above. Finally, cap 32 can be removed from vial 29 to allow access to the interior of vial 29. For the most part, reversal of this process will return object retention device 20 to its original, coupled status. However, release button 43 need not be depressed for re-insertion of inner body 22 into outer body cavity 41. In the preferred embodiment, as inner body 21 engages loop taper 71 of loop bottom 75, retaining loop 45 is moved downward to enable easy insertion of inner body 22. In other embodiments, loop taper 71 is omitted, and the front end of inner body 21 is constructed with a sufficient taper so as to move retaining loop 45 downward. As inner body loop channel 23 becomes aligned with outer body loop channel 46, loop bottom 75 moves into inner body loop channel 23 due to force from leaf spring 80.

Figure 12:
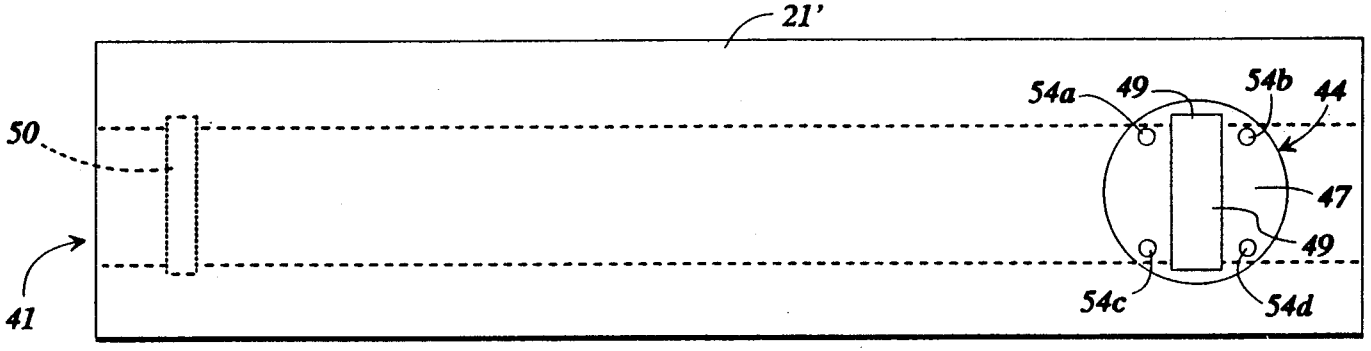
FIG. 12 is an isolated top view of an alternate outer body similar to the view of the preferred embodiment shown in FIG. 5b.

A first acceptable alternate embodiment of release assembly 70 of FIGS. 6 and 7, is shown, in part, in FIGS. 12–14b. This alternate embodiment utilizes release button 43 and retaining loop 45 of the preferred embodiment. (Subsequent references to these elements should be understood as referring to FIGS. 6 and 7.) However, outer body 21, leaf spring 80, and retaining ring 65 of FIGS. 6 and 7 are replaced by the alternate elements shown in FIGS. 12–14b. FIG. 12 is a top view of outer body 21' similar to the view of the preferred embodiment shown in FIG. 5b. Release aperture 44, release shoulder 47, and release slot 49 are roughly similar in shape and dimensions to the preferred embodiment. Yet the salient addition to this alternate embodiment is the multitude of tapered anchor holes 54a–54d.

Figure 14A:
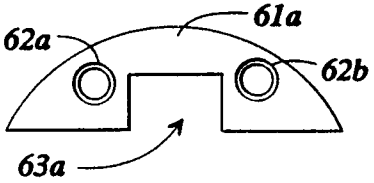
FIG. 14a is an isolated top view of anchor plates.
Figure 14A:
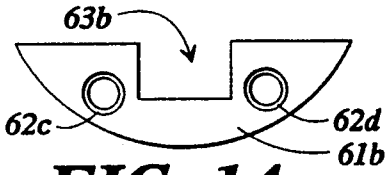
Figure 14B:
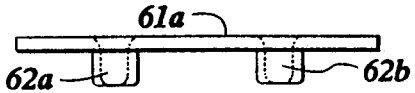
FIG. 14b is an isolated right side view of an anchor plate.
Figure 13B:
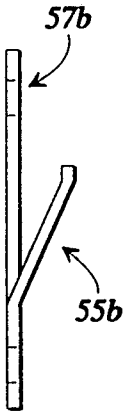
FIG. 13b is an isolated front view of a spring plate.
Figure 13A:
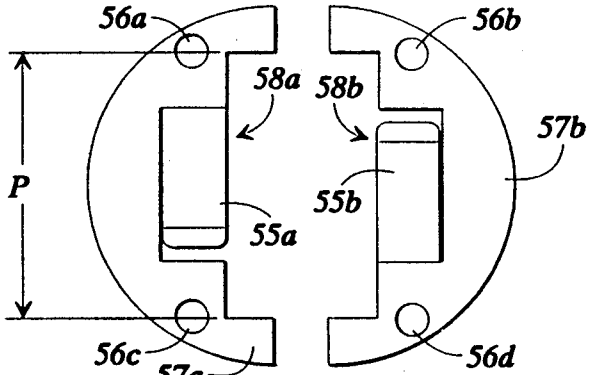
FIG. 13a is an isolated top view of spring plates.

FIG. 13a is a top view of spring plates 57a and 57b. Anchor passages 56a–56d, spring arms 55a and 55b, and spring plate loop recesses 58a and 58b are shown formed into spring plates 57a and 57b. FIG. 13b is a front view of spring plate 57b, showing the vertical extension of spring arm 55b. FIG. 14a is a top view of anchor plates 61a and 61b. Anchor pins 62a–62d and anchor plate loop recesses 63a and 63b are seen formed into anchor plates 61a and 61b. FIG. 14b is a right side view of anchor plate 61a, showing the vertical extension of anchor pins 62a and 62b. In this embodiment, spring plates 57a and 57b are preferably made from stamped spring steel, and anchor plates 61a and 61b are preferably made from die cast brass, die cast zinc, molded nylon, or stamped metal.

With reference to FIGS. 12–14b, assembly of this first alternate release assembly embodiment begins with the insertion of retaining loop 45 into release slot 49. Spring plates 57a and 57b are then inserted into release aperture 44 so that spring arms 55a and 55b extend upward away from anchor holes 54a–54d, and so that anchor passages 56a–56d are aligned with anchor holes 54a–54d, respectively. In other words, anchor passage 56a is aligned with anchor hole 54a, and so on. Furthermore, when spring plates 57a and 57b are placed in release aperture 44, spring plate loop recesses 58a and 58b come together to form a rectangle which resembles and is positioned directly over release slot 49. This newly formed rectangle has a width that is roughly equivalent to the width of release slot 49. However, the length of this newly formed rectangle is smaller than the length of release slot 49. The length of this rectangle is the length of spring plate loop recesses 58a and 58b, indicated by distance "p", and is slightly greater than the length of loop top 73, indicated as distance "t" in FIG. 8a. Because loop shoulders 72 extend longer than the length of this new rectangle, retaining loop 45 is held in place as long as spring plates 57a and 57b remain in release aperture 44.

Anchor plates 61a and 61b are then placed into release aperture 44 over spring plates 57a and 57b. Anchor pins 62a–62d are inserted through anchor passages 62a–62d, respectively, and into anchor holes 54a–54d, respectively. In other words, anchor pin 62a is inserted through anchor passage 62a and into anchor hole 54a, and so on. Anchor pins 62a–62d and anchor holes 54a–54d are designed so that anchor pins 62a–62d can be wedged tightly into anchor holes 54a–54d, thereby securely holding spring plates 57a and 57b, and thus retaining loop 45, in place. The rectangle formed from anchor plate loop recesses 63a and 63b by placement of anchor plates 61a and 61b will be directly over, and have essentially the same dimensions, as the previously discussed rectangle formed from placement of spring plates 57a and 57b. Release button 43 is then attached to loop top 73 as in the preferred embodiment. Forces from spring arms 55a and 55b then, through contact with the bottom of release button 43, bias retaining loop 45 upward.

An alternate method of construction considered to be within the scope of the present invention includes the steps of first placing retaining loop 45 within release slot 49, placing anchor plates 61a and 61b (in an upside down orientation) onto a separate movable holder having four magnetic prongs oriented similar to anchor holes 54a–54d, placing spring plates 57a and 57b (in an upside down orientations) onto the movable holder and on top of anchor plates 61a and 61b, mechanically moving the holder to place plates 61a, 61b, 57a, and 57b in the previously mentioned locations within release aperture 44.

Figure 16A:
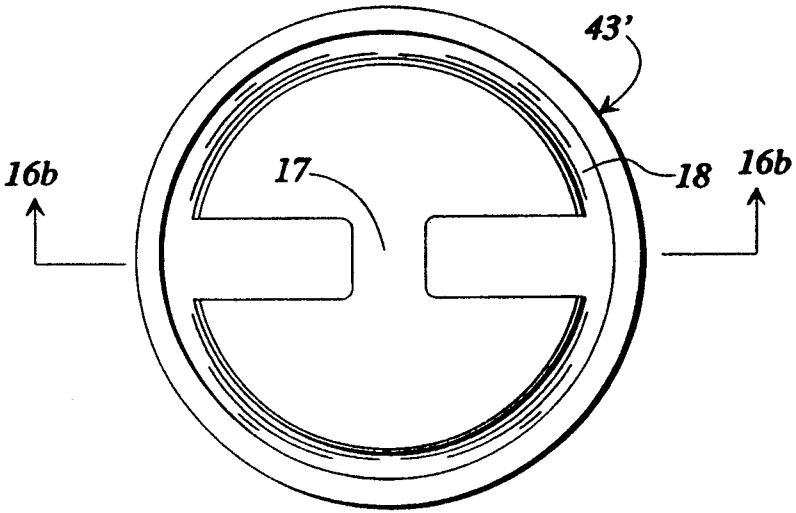
FIG. 16a is an isolated bottom view of an alternate embodiment of a release button.
Figure 16B:
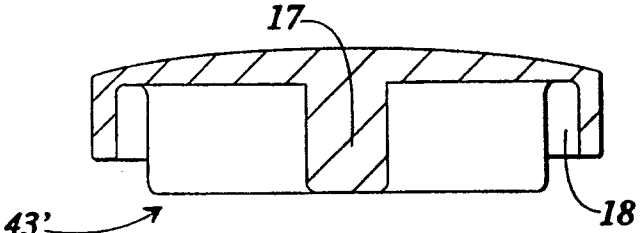
Figure 15:
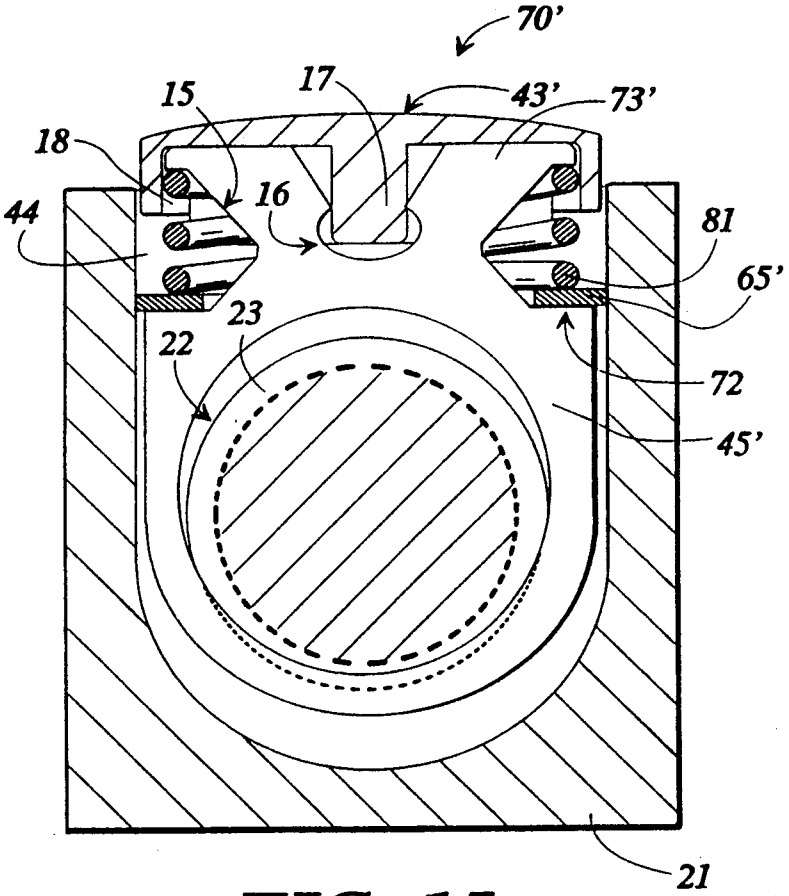
FIG. 15 is a cross-sectional front view, similar to FIG. 7, of an alternate embodiment of a release assembly.

A second alternate release assembly embodiment is shown in FIGS. 15 and 16b. FIG. 15 is a cross-sectional front view of this alternate embodiment which is similar to that of FIG. 7 of the preferred embodiment. Outer body 21 and inner body 22, complete with inner body loop channel 23, are similar to the corresponding elements in the preferred embodiment. However, release button 43', retaining loop 45', retaining ring 65', and coil spring 81 are different from the corresponding elements of the preferred embodiment. FIG. 16a shows a bottom view of release button 43'. FIG. 16b shows a cross-sectional front view, taken along line 16b of FIG. 16a. Release button 43' is seen including button plug 17.

It can be seen from FIG. 15 that retaining loop 45 of this embodiment is configured differently from the retaining loop of previous embodiments. Included in loop top 73', are spring coves 15 defined on each side of loop top 73' and a plug catch 16 defined in the center of loop top 73. Plug catch 16 creates a one-way grip on button plug 17 when release button 43' is assembled onto retaining loop 45. Retaining ring 65' is seen positioned within release aperture 44 without the ring wings of the preferred embodiment, but performing the similar function of holding retaining loop 45' in place. Coil spring 81 is positioned in spring coves 15, between the top portion of loop top 73' and retaining ring 65' so that upward force from coil spring 81 is first received by retaining loop 45', rather than by release button 43'. Also, the shoulders of spring channel 18 provide alignment for coil spring 81, ensuring that coil spring 81 remains in a proper position. In other alternate embodiments, an elastic "O-ring" or other elastic material is used in place of coil spring 81.

Figure 17:
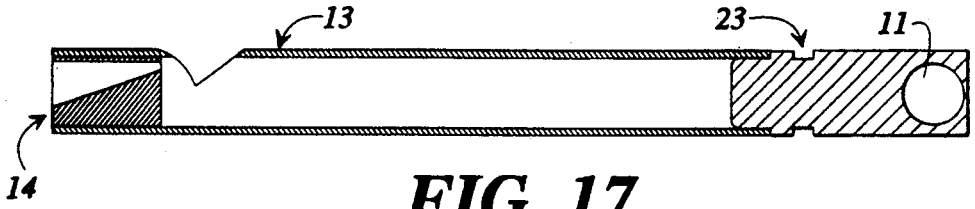
FIG. 17 is a cross-sectional right side view of an alternate embodiment of an inner body whistle.

Another alternate embodiment of the present invention includes whistle inner body 13 shown in FIG. 17, a cross-sectional right side view. Whistle inner body 13 is insertable into outer body cavity 41 of outer body 21, shown in FIG. 5a. When inserted, whistle front 14 of whistle inner body 13 is kept clean. Whistle inner body 13 is shown including inner body loop channel 23 and inner body ring hole 11. By blowing through whistle front 14, a whistling noise may be generated for various well-known purposes.

Figure 18:
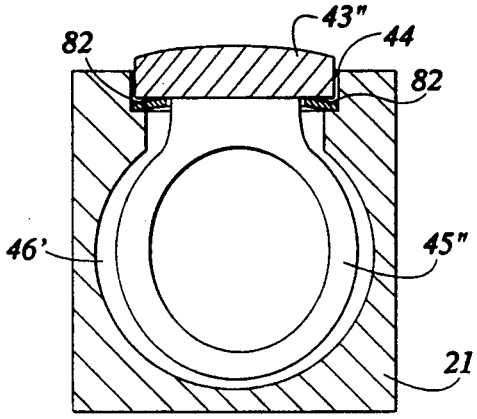
FIG. 18 is a cross-sectional front view of another alternate release assembly embodiment.

FIG. 18 shows a cross-sectional front view of another alternate release assembly embodiment. Release button 43" and retaining loop 45" are seen assembled as a unitary construction. Other embodiments include attaching separate button and loop elements through glue or other similar adhesive. Resting within release aperture 44 and between release button 43" and outer body 21 is elastic O-ring 82. Elastic O-ring 82 is preferably constructed with adhesive on top and bottom surfaces for attachment to release button 43'' and outer body 21. During operation, when release button 43'' is depressed, (compressing elastic O-ring 82) retaining loop 45' moves downward to clear outer body loop channel 46', thus releasing inner body member 22, shown in FIG. 4a, in a manner relatively similar to that discussed above.

Figure 19:
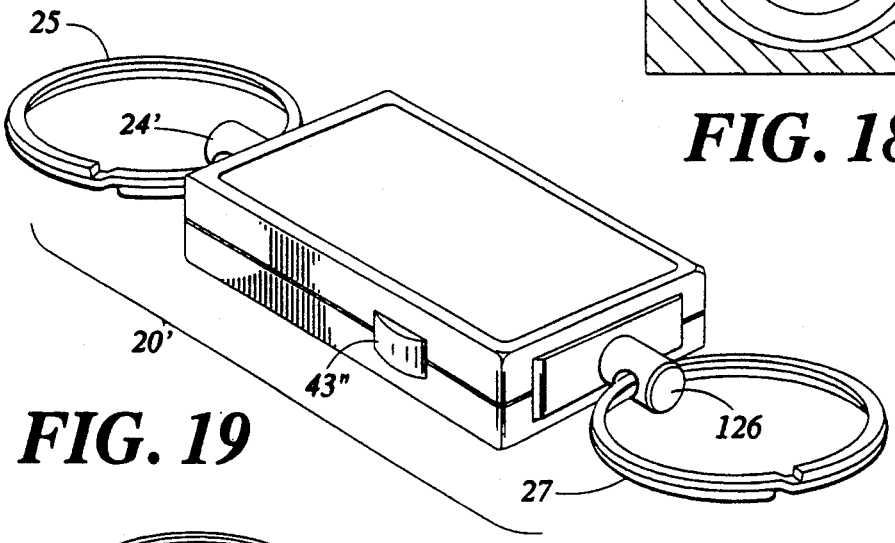
FIG. 19 is a pictorial view of an object retention device with body members joined together.
Figure 20:
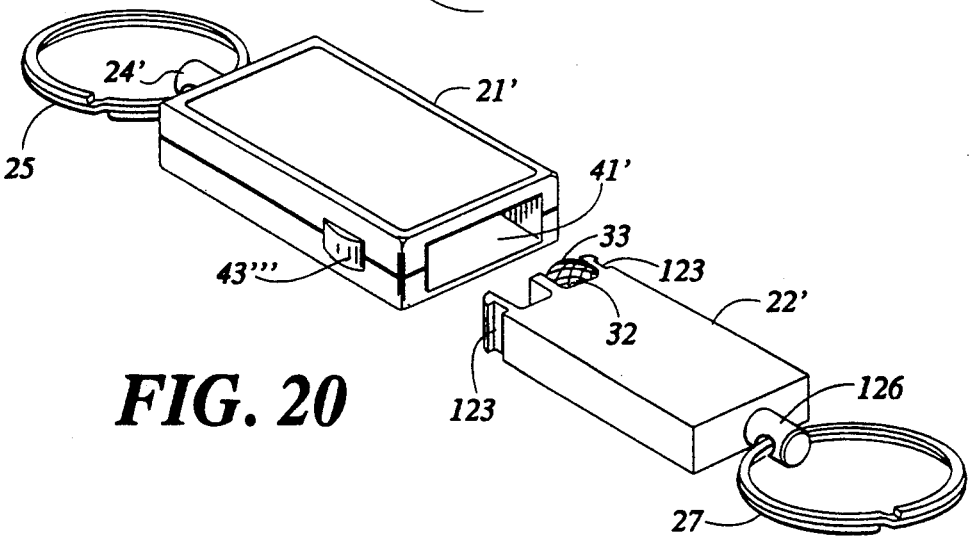
FIG. 20 is a pictorial view of the embodiment of FIG. 19, showing the body members separated.

FIGS. 19-23 show another alternate embodiment of the present invention. FIG. 19 is a pictorial view of object retention device 20' with body members joined together, and FIG. 20 is a pictorial view of the embodiment of FIG. 19, showing the body members separated. Outer body ring 25 is attached to outer body 21' through swivel 24', and inner body ring 27 is attached to inner body 22' through inner body swivel 126. Release button 43''' is attached to the side of outer body 21'. A relatively rectangular-shaped outer body cavity 41' is defined within outer body 21'. Inner body 22' includes release channels 123, and textured grip end 33 of cap 32 is seen partially inserted into inner body 22'.

Figure 21:
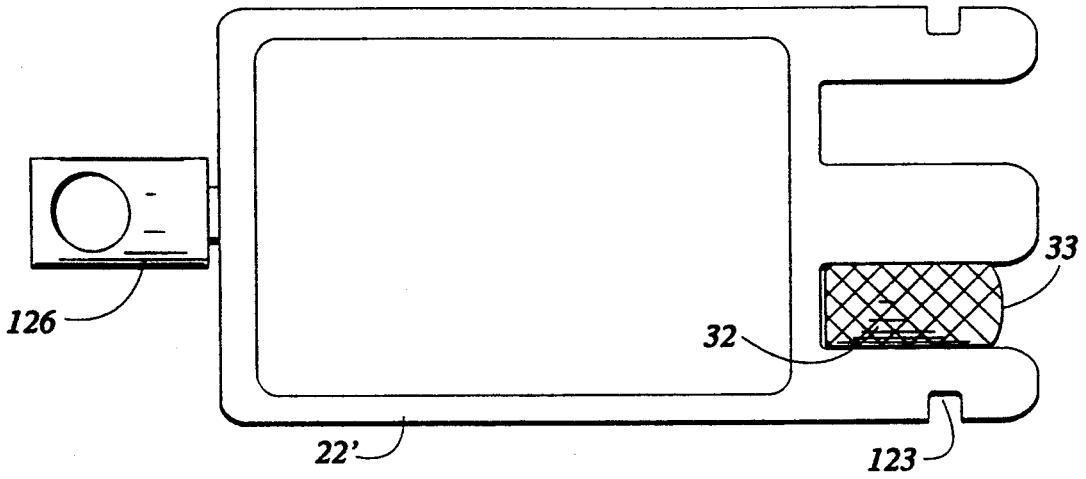
FIG. 21 is a top view of the inner body of FIG. 20.
Figure 22:
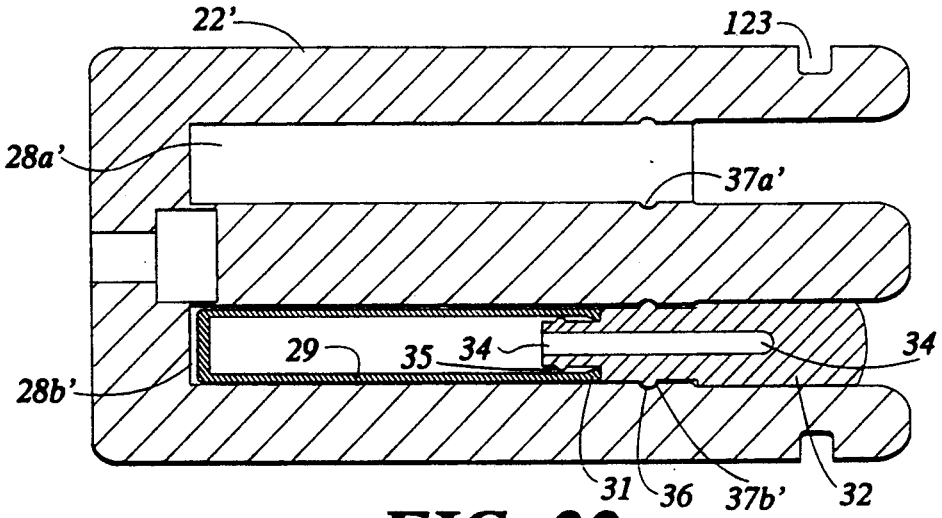
FIG. 22 is a cross-sectional top view of the inner body of FIG. 20.
Figure 23:
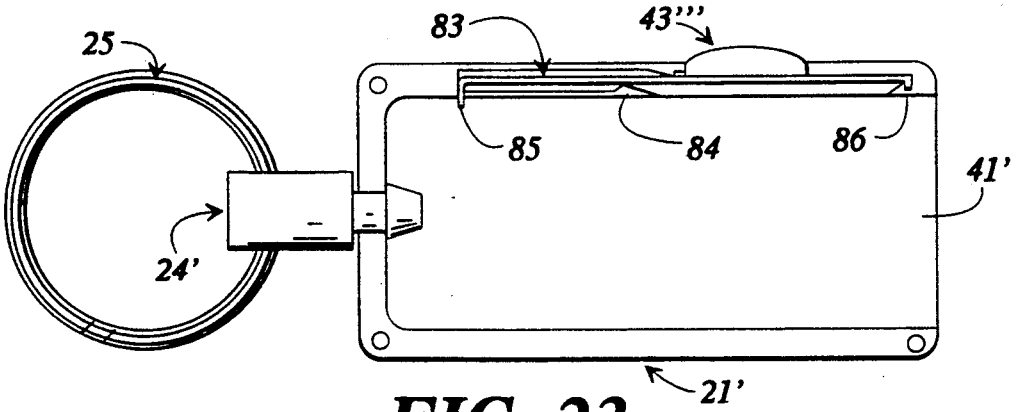
FIG. 23 is a cross-sectional top view of the outer body of FIG. 20.

FIGS. 21 and 22 are top and cross-sectional top views, respectively, of inner body 22'. Storage areas 28a' and 28b' are defined by inner body 22'. Cap 32 and vial 29 are seen partially inserted into storage area 28b'. Similar to the preferred embodiment, vial 29 includes raised bead 31, and cap 32 includes compression channel 34, vial retention ring 35, and body retention ring 36. Storage channels 28a' and 28b' also define cap retention channels 37a' and 37b', respectively. FIG. 23 is a cross-sectional top view of outer body 21' which also shows outer body ring 25 and swivel 24'. Release button 43''' is attached to spring arm 83 which is attached to outer body 21' at spring arm fixed end 86 and extends down into outer body cavity 41' at spring arm free end 85. Fulcrum 84 is also seen contacting the bottom of spring arm 83 between release button 43''' and spring arm free end 85.

It should be clear that cap 32 can be used with or without vial 29 to seal either storage area 28a' or 28b'. An additional cap 32 may also be used so that both storage areas are sealed. Alternately, storage areas 28a' and 28b' can be used without cap 32 when solids, such as pills, are stored. Furthermore, the operation and utility of cap 32 and vial 29 are similar to that discussed above with reference to the preferred embodiment. When inner body 22' of this embodiment is inserted into outer body cavity 41', release channel 123 catches on spring arm free end 85 to couple inner body 22' within outer body 21'. Depressing release button 43''' causes spring arm 83 to cooperate with fulcrum 84 to drive spring arm free end 85 upward, out of release channel 123. Inner body 22' may then be separated from outer body 21'.

It should be understood that the scope and spirit of the present invention includes other applications of the various elements and features of the present invention. For example, the various release assemblies disclosed herein have application in other devices unrelated to object retention.

While the embodiments of the present invention which have been disclosed herein are the preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that the relative dimensions and relationships shown on the drawings are given as the preferred relative dimensions and relationships, but the scope of the invention is not to be limited thereby.

I claim:

1. A key chain, comprising:

a body having a first end and a second end and defining an open space accessible from said first end of said body;

key retention means connected to said second end of said body for attaching keys to said body;

a cap;

cap retention means for holding said cap at a position which covers said cavity;

a hollow vial for insertion into said open space of said body, said hollow vial including an opening at one end and a bead around said vial opening; and said cap comprising, at least, a protrusion for insertion into said hollow vial, and a ridge around said cap protrusion which positively engages with said bead to seal said vial opening.

2. Apparatus of claim 1, wherein said cap further comprises a hollow compression channel extending through said protrusion and into said cap.

3. A key chain, comprising:

a first body having a first end and a second end and defining a compartment within said first body accessible from said first end of said first body;

key retention means connected to said second end of said first body for attaching keys to said first body;

a cap;

cap retention means for holding said cap at a position which covers said compartment;

a second body including, at least, a first end and a second end, and defining a compartment accessible from said first end of said second body and sized to closely accommodate said first body; and object retention means attached to said second end of said second body for attaching keys to said second body.

4. A key chain, comprising:

a first body having a first end and a second end and defining a cavity within said first body accessible from said first end of said first body;

key retention means connected to said second end of said first body for attaching keys to said first body;

a second body for at least partial insertion into said cavity; and detention means for releasably holding said second body at least partially within said cavity, wherein said detention means includes, at least, a loop element attached to said first body, and means for moving said loop element between a first position in which said loop element engages said second body and a second position in which said loop element does not engage said second body.

5. Key chain of claim 4, wherein said means for moving said loop element between the first position and the second position comprises an aperture through one side of said first body, connecting the exterior of said first body with said cavity; and a push button connected to said loop element, mounted to be accessible from the exterior of said first body through said aperture.

6. A key chain, comprising:

a first body having a first end and a second end and defining a cavity accessible from said first end of said first body;

key retention means connected to said second end of said first body for attaching keys to said first body;

a second body for at least partial insertion into said cavity;

detention means for releasably holding said second body at least partially within said cavity, said second body having a first end and a second end and defining a cavity accessible from said first end of said second body;

a cap for insertion partially into said cavity of said second body; and a hollow vial for insertion into said cavity of said second body, said hollow vial including an opening at one end and a bead around said vial opening, wherein said cap further includes, means for securing said cap to said second body and to said vial.

7. An apparatus, comprising:

a body including, at least, a first and a second end and defining a cavity accessible from said first end of said body;

object retention means connected to said second end of said body for attaching keys to said body;

a flexible cap for insertion partially into said cavity; and cap retention means for holding said cap at a position which covers said cavity.

8. Apparatus of claim 7, wherein said cap retention means comprises an external annular bead on said cap and an annular groove defined in said cavity near said body member first end.

9. An apparatus, comprising:

a first body including, at least, a first end and a second end and defining a cavity accessible from said first end of said first body and extending toward said second end of said first body;

a second body including, at least, a first end and a second end and defining a cavity accessible from said first end of said second body and extending toward said second end of said second body; and detention means for releasably connecting said first body to said second body, with said second body at least partially inserted within said cavity of said first body, wherein said first body first end is adjacent to said second body second end and said first body second end is adjacent to said second body first end.

10. Apparatus of claim 9, further comprising object retention means for attaching objects to said apparatus, connected to said second end of one of said first body and said second body.

11. Apparatus of claim 9, wherein said detention means further comprises, at least, a channel around said second body; a loop element attached to said first body; and means for moving said loop element between a first position in which said loop element partially occupies said channel and a second position in which said loop element does not occupy said channel.

12. Apparatus of claim 11, wherein said means for moving said loop element between the first position and the second position comprises an aperture through one side of said first body, connecting an exterior of said first body with said cavity of said first body; and a push button connected to said loop element, mounted to be accessible from the exterior of said first body through said aperture.

13. Apparatus of claim 10, further comprising second object retention means for attaching objects to said apparatus, connected to said second end of the other one of said first body and said second body.

14. Apparatus of claim 9, further comprising a cap and cap retention means for holding said cap at a position which seals said cavity of said second body member.

15. Apparatus of claim 14, wherein said cap is made of a flexible material.

16. Apparatus of claim 14, further comprising:

a hollow vial for insertion into said cavity of said second body, said hollow vial including an opening at one end; and a vial attachment means for attaching the open end of said vial to said cap.

17. Apparatus of claim 16, wherein said vial attachment means comprises, at least, a bead around said vial opening;

a cap appendage for insertion into said hollow vial; and a ridge around said cap appendage which positively engages with said bead when said appendage is inserted into said vial opening.

18. Apparatus of claim 14, wherein said cap retention means comprises, at least, an appendage for insertion into said cavity of said second body and a hollow compression channel extending through said appendage and into said cap.

19. Apparatus of claim 18, further comprising a wick inserted partially into said compression channel.

20. Apparatus of claim 9, wherein said detention means comprises, at least, a channel around said second body;

a loop element attached to said first body to allow movement of said loop element between a first position, in which said loop element at least partially occupies said channel, and a second position, in which said loop element does not occupy said channel; and biasing means for biasing said loop element toward said first position.

21. Apparatus of claim 20, wherein said detention means further comprises a force translation element for accepting an external force to overcome said biasing means and move said loop element toward said second position.

22. Apparatus of claim 20, wherein said biasing means comprises a spring member.

23. Apparatus of claim 22, wherein said spring member is a leaf spring.

24. Apparatus of claim 22, wherein said spring member is a coil spring.

25. Apparatus of claim 20, wherein said biasing means comprises an elastic O-ring.

26. Apparatus of claim 14, further comprising a hollow vial for insertion into said cavity of said second body, said hollow vial including an opening at one end and a bead around said vial opening; and said cap further comprising, at least, a protrusion for insertion into said hollow vial, and a ridge around said cap protrusion which positively engages with said bead to seal said vial opening.

27. Apparatus of claim 14, wherein said cap retention means comprises an external annular bead on said cap and an annular groove defined in said cavity of said second body near said first end of said second body.

28. Apparatus of claim 27, further comprising a hollow vial for insertion into said cavity of said second body, said hollow vial including an opening at one end and a bead around said vial opening; and said cap further comprising, at least, a protrusion for insertion into said hollow vial, and a ridge around said cap protrusion which positively engages with said bead to seal said vial opening.

29. Apparatus of claim 28, wherein said cap further comprises a hollow compression channel extending through said protrusion and into said cap.

30. A key chain comprising:

a first body having a first end and a second end and defining an open space accessible from said first end of said first body;

key retention means connected to said second end of said first body for attaching keys to said first body;

a second body having a first end and a second end and defining an open space;

detention means for releasible holding said second body at least partially within said open space of said first body;

a cap; and cap retention means for holding said cap at a position which covers said open space of said second body.

31. Key chain of claim 30, wherein said second body further includes, at least, object retention means, attached to said second end of said second body, for attaching keys to said second body.

32. Key chain of claim 31, wherein said second body further defines a second open space.

33. An object retention apparatus comprising:

a body including, at least, a first end and a second end and defining a cavity accessible from said first end of said body;

a cap; and cap retention means for detachably holding said cap in a position where said cap covers said cavity of said body, said cap retention means comprising, at least, an appendage for insertion into said cavity of said body, a ridge around said appendage, and a channel within said cavity of said body.

34. Apparatus of claim 33, further comprising:

a hollow vial for insertion into said cavity of said body, said hollow vial including an opening at one end and a bead around said vial opening, said cap further comprising a second ridge around said appendage which positively engages with said bead to seal said vial opening.

35. Apparatus of claim 33, further comprising a hollow compression channel extending axially through said appendage and into said cap; and a wick inserted partially into said compression channel.

36. Apparatus of claim 33, further comprising object retention means, attached to said second end of said body, for attaching objects to said body.

37. Coupling apparatus for releasably coupling a first body to a second body, the first body including a cavity for receipt of at least a portion of the second body, said apparatus comprising:

a retaining loop slidably connected to and at least partially within a first body, said retaining loop defining an opening for receipt of a second body;

an external means connected to said retaining loop for receiving from a user, and transferring to said retaining loop, force tending to slide said retaining loop in a first direction within the first body to release the second body; and a biasing means connected to said retaining loop for exerting force on said retaining loop tending to slide said retaining loop in a second direction opposite to the first direction to couple the second body.

38. Apparatus of claim 37, wherein said external means comprises a push button.

39. Apparatus of claim 37, further comprising a retaining ring means connected to said retaining loop and the first body for holding said retaining loop at least partially within the first body.

40. An apparatus comprising:

a first body including, at least, a first end and a second end and defining a cavity accessible from said first end of said first body;

a second body including, at least, a first end, a second end, and means for creating a whistling noise by blowing through said first end of said second body; and detention means for releasably connecting said first body to said second body, with said second body at least partially inserted within said cavity of said first body, wherein said first body first end is adjacent to said second body second end and said first body second end is adjacent to said second body first end.

* * * * *